United States Patent [19]

Ruckstuhl

[11] Patent Number: 4,496,266

[45] Date of Patent: Jan. 29, 1985

[54] CURVED LIKE PAVING STONE ELEMENT FOR USE IN SETTING A CURVED PAVING

[75] Inventor: Willi Ruckstuhl, Kloten, Switzerland

[73] Assignee: Kronimus & Sohn GmbH & Co. KG, Iffeshein, Fed. Rep. of Germany; a part interest

[21] Appl. No.: 446,987

[22] Filed: Dec. 6, 1982

[30] Foreign Application Priority Data

Dec. 30, 1981 [CH] Switzerland ..... 3151876

[51] Int. Cl.[3] ..... E01C 5/00

[52] U.S. Cl. ..... 404/41; 404/38

[58] Field of Search ..... 404/41, 42, 34, 38

[56] References Cited

U.S. PATENT DOCUMENTS

| | | | |
|---|---|---|---|
| 2,138,270 | 11/1938 | Fagan | 404/38 |
| 3,343,468 | 9/1967 | Schraudenbach | 404/38 |

FOREIGN PATENT DOCUMENTS

| | | | |
|---|---|---|---|
| 515227 | 11/1952 | Belgium | 404/41 |
| 573198 | 3/1933 | Fed. Rep. of Germany | 404/34 |
| 2707558 | 8/1978 | Fed. Rep. of Germany | 404/42 |
| 3216082 | 11/1983 | Fed. Rep. of Germany | 404/41 |
| 300762 | 9/1932 | Italy | 404/42 |
| 302511 | 10/1932 | Italy | 404/42 |
| 123291 | 4/1928 | Switzerland | 404/34 |
| 8529 | of 1840 | United Kingdom | 404/41 |
| 136 | of 1881 | United Kingdom | 404/41 |
| 2012332 | 7/1979 | United Kingdom | 404/42 |

*Primary Examiner*—Stephen J. Novosad
*Assistant Examiner*—Beverly E. Hjorth
*Attorney, Agent, or Firm*—Collard, Roe & Galgano

[57] ABSTRACT

The invention relates to a curved like paving stone element for setting of a curved paving, characterized in that the curved element is limited by an outer circular curve having a radius and an inner circular curve having the same radius with the center points of the circular curves disposed on a radial straight at a distance from each other corresponding to the largest width of the curved element. The curved element consists of two outer stones and a center stone of about the same curvature length, where the outer stones are separated into three individual stones by means of non-continuous separating joints and the center stone is separated into either two or three individual stones. The curved element is asymmetrically offset with respect to the radial straight in such a manner that the outer edge of an outer stone is smaller than the opposite outer edge of the other outer stone and the size of this difference corresponds to about the width of the stone with the smaller outer edge.

6 Claims, 6 Drawing Figures

CURVED LIKE PAVING STONE ELEMENT FOR USE IN SETTING A CURVED PAVING

The present invention relates to a curved like paving stone element for use in setting a curved paving.

Interconnected paving stones with which normal surface pavings can be constructed and which are used as a substitute for paving with natural paving stones are well known. However, with known interconnected paving stones, as well as with natural paving stones, it is difficult to form a curved paving since stones of different sizes must always be adjusted and individually set so as to obtain the desired setting pattern. Since such a type of paving is too difficult to perform by the layman, such curved pavings are only performed by experts, whereby these experts must choose individual stones and adjust them to the desired paving pattern. Thus, such paving is very expensive and, in addition, the making and stockpiling of such a variety of individual stone shapes is an additional expense factor.

It is, therefore, an object of the present invention to provide a curved like paving stone element for the setting of a curved paving which is not only considerably less expensive with respect to the manufacture of individual stones, but which can also be set by a layman in a curved paving in a clean and efficient manner. From a visual viewpoint the paving does not differ from a paving which is performed with individual stones and is thus able to replace the same to a great extent.

For the accomplishment of the object of this invention, a curved like paving stone element is suggested for setting a curved paving which is characterized in that the curved element is limited by an outer circular curve having a given radius and an inner circular curve having the same radius. The centers of the circular curves are disposed on a radial straight at a distance from each other which corresponds to the largest width of the curved element. The curved element consists of two outer stones and a center stone of about the same curve length. Each of the outer stones are separated into three smaller individual stones by means of noncontinuous separating joints and the center stone is separated into two or three individual stones, whereby the curved paving stone element is asymmetrically offset with respect to the radial straight in such a manner that one outer edge thereof is smaller than its opposing outer edge and the amount of the difference corresponds to about the width of the stone having the smaller outer edge.

With the curved like paving stone element in accordance with the present invention a substantial advantage is obtained in that by simply joining together the individual stones of the curved elements and by an alternate changing of the two different center stones a curved paving can easily be constructed by a layman since the circular curve limit lines have the same radii whereby the curved elements can be joined together by maintaining the corresponding joints. Due to the asymmetric offsetting of the curved elements, the following curved element can be joined to the first set curved element during the setting operation, since the last one of the individual stones which is separated by the noncontinuous joint forms the connecting part to the next curved element.

Preferred shapes of the paving stone elements in accordance with the invention are stated in the claims in their geometric dimensions, which can be made relatively easily and with which setting can be performed particularly well.

Other objects and features of the present invention will become apparent from the following detailed description considered in connection with the accompanying drawings, which discloses one embodiment of the invention. It is to be understood that the drawings are to be used for the purposes of illustration only, and not as a definition of the limits of the invention.

In the drawings, wherein similar reference characters denote similar elements throughout the several views.

Figures 2, 2A:
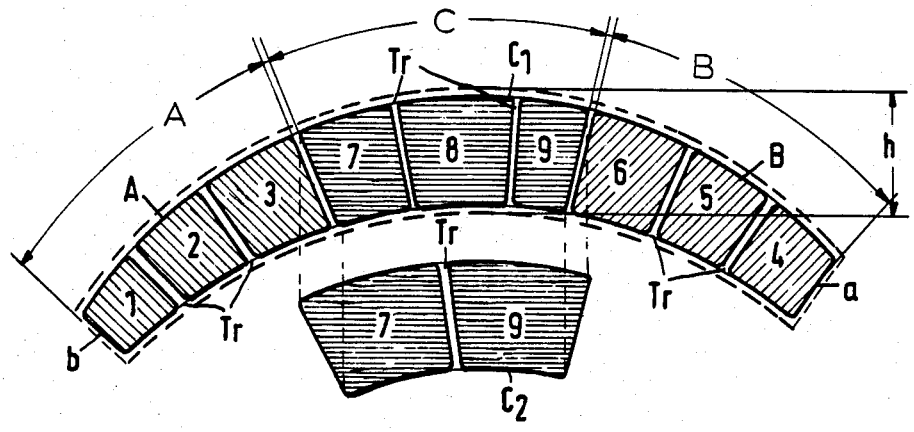
FIG. 2 shows the separation of the curved element in accordance with the invention.
Figure 3:
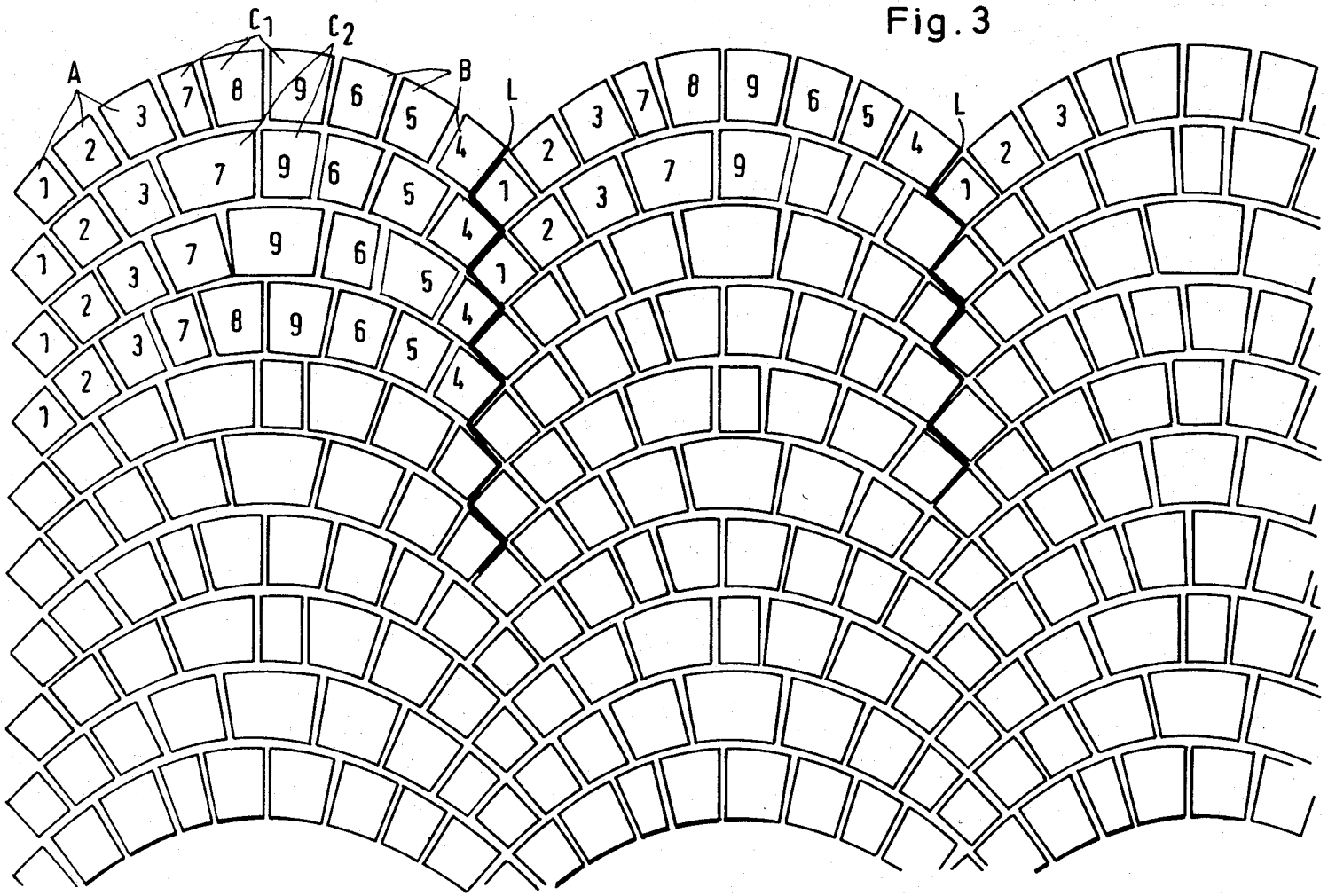
Figure 4:
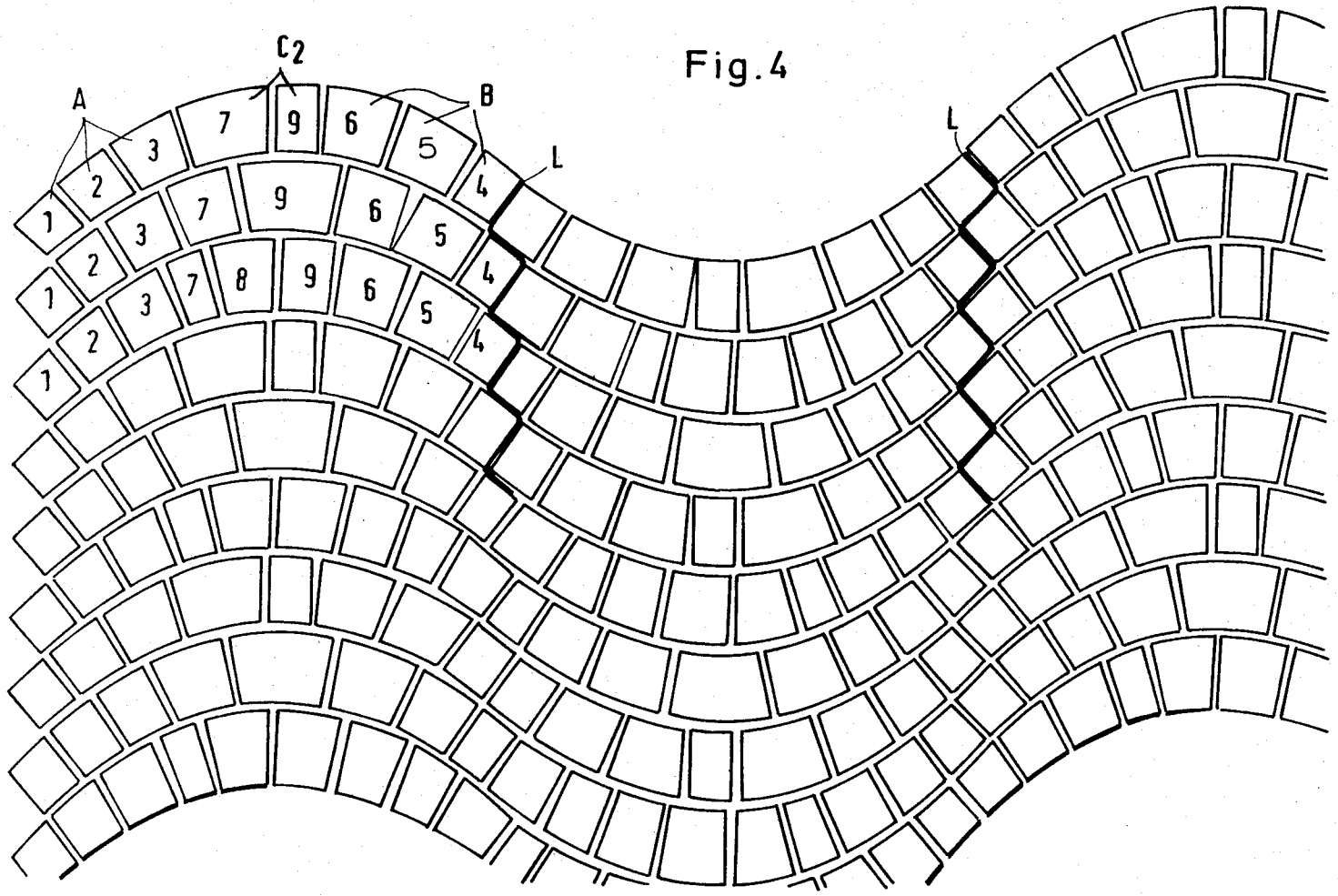
Figure 5:
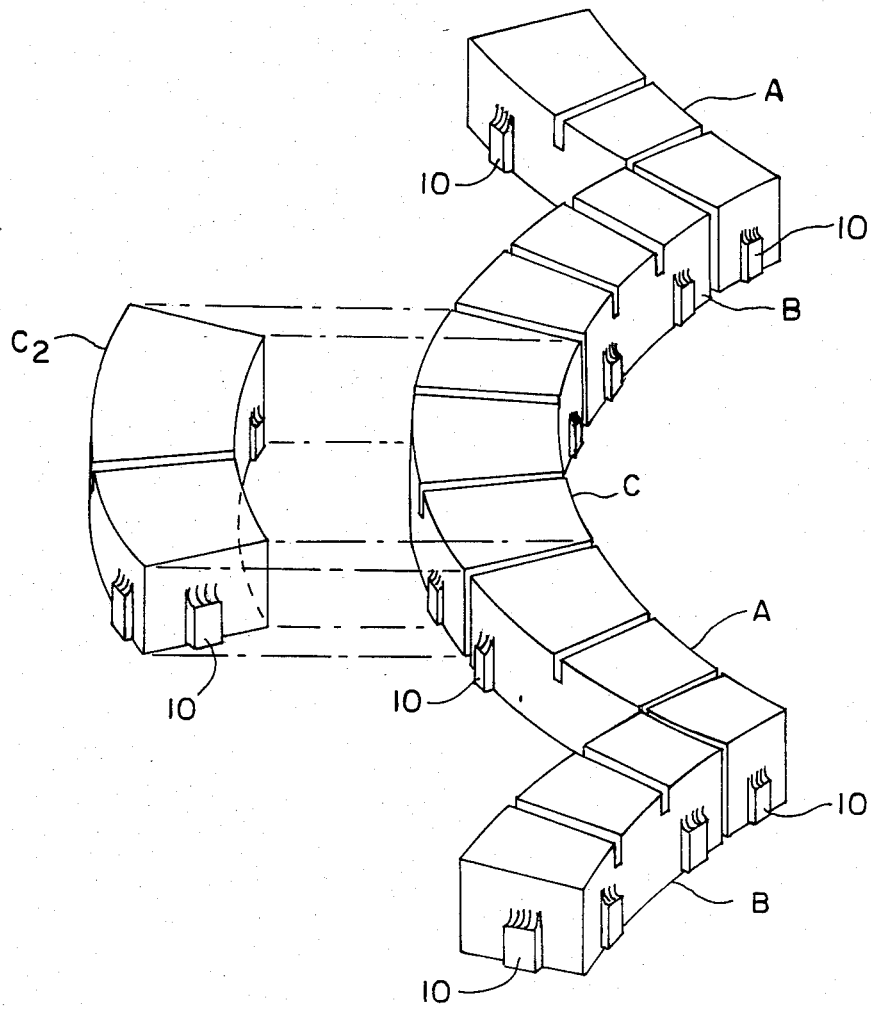

FIG. 2*a* shows a further possibility of separating the apex stone in the curved element;

FIG. 3 shows a set pattern of curved paving with the paving stone elements in accordance with the invention;

FIG. 4 shows a further set pattern of paving with the paving stone elements in accordance with the invention; and FIG. 5 is a perspective view of the curved element in accordance with the invention.

Figure 1:
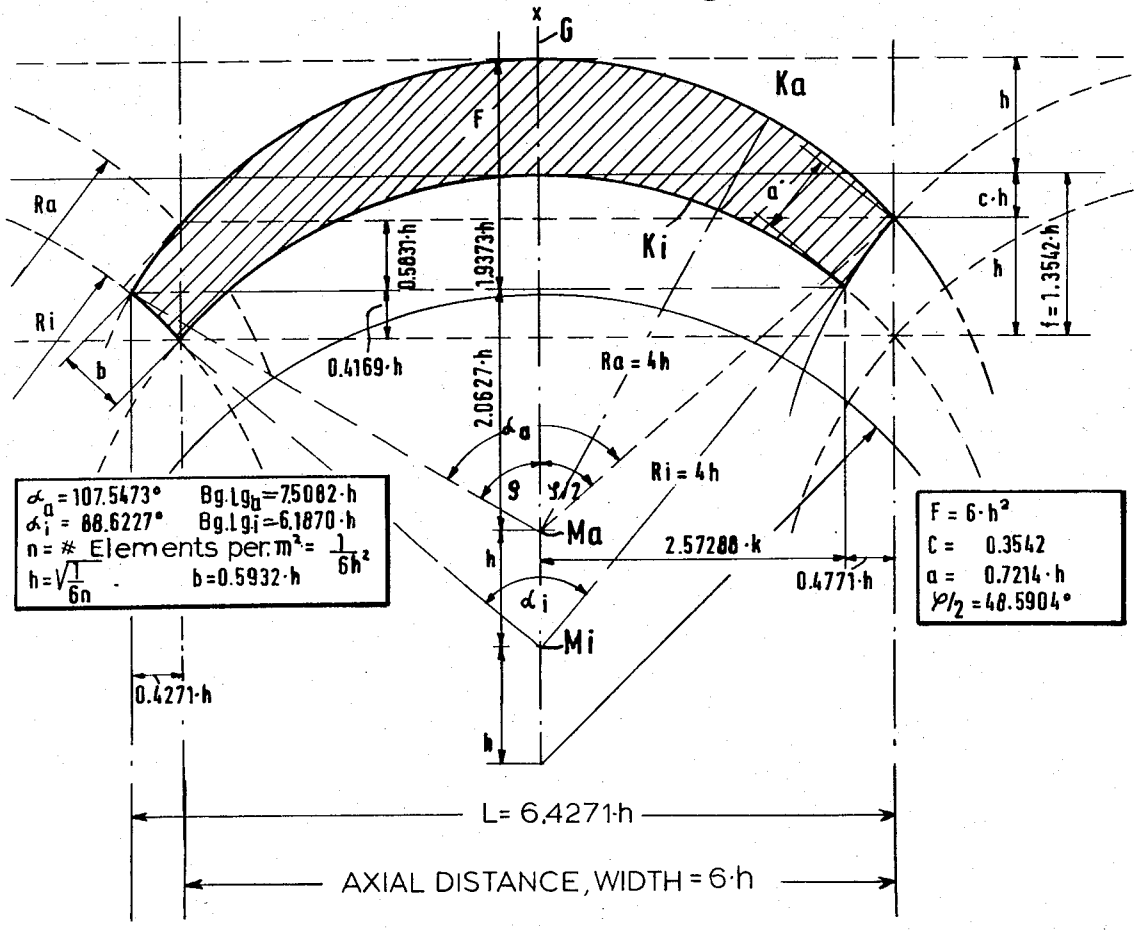
FIG. 1 is a geometric illustration of the curved element in accordance with the invention.

FIG. 1 illustrates the limit lines of the curved like paving element in accordance with the invention in their geometric interrelationships. These lines consist of the outer circular curve Ka, the inner circular curve Ki and the two outer edges a and b. The total surface of the shaded curved element is designated by F. The center point Ma of the outer circular curve Ka and the center point Mi of the inner circular curve Ki are disposed on a radial straight G, being the line drawn between these two points, at a distance h from each other. The essential relationship is that the radii Ra and Ri are equal in length.

In the illustrated example Ra and therefore also Ri equal 4h. The width or axial distance of the span of the outer circular curve Ka between adjacent curved like paving elements is 6 h.

In accordance with the invention, the curved element is asymmetrical extended on the left side of radial straight G, so that the outer edge b is smaller on this side of the curved element than the outer or opposing edge a on the right side of the curved element. The amount of this offset will be explained in more detail when describing the separation of the curved element into individual stones. In the illustrated example, the geometric conditions are such that the angle $\alpha_a$ of the outer circular curve Ka is 107.5473° and the angle $\alpha_i$ of the inner circular curve Ki is 88.6227°. The total length L of the span of the outer circular curve Ka is 6.4271h. The remaining geometric relationships can be seen in FIG. 1, where in particular the remaining curved elements are illustrated in a curved paving. Specifically, the length of curve $K_a$ is 7.5082h and the length of curve $K_i$ is 6.1870h.

As can be seen in FIG. 2 and FIG. 5, the curved element is separated into three stones, namely a bearing stone A, an apex stone C and a further bearing stone B. The distance h corresponds to the largest stone width of the paving stone element in the apex stone C. The length of the curves of the individual stones A, B and C are the same. The surface of the three stones A, B and C corresponds to the surface F in FIG. 1.

The individual stones A, B and C are further subdivided into three individual stones by means of non-continuous separating joints Tr, whereby the bearing stone A is subdivided into individual stones numbered 1, 2 and 3, the apex stone $C_1$ into individual numbered stones 7, 8 and 9 and the bearing stone B into individual stones numbered 4, 5 and 6.

As can be seen in FIG. 2*a*, the apex stone $C_2$ is subdivided into two individual stones numbered 7 and 9 by only one non-continuous separating joint Tr. By means of alternately interchanging stones $C_1$ and $C_2$ a specific number of integral curves in the shown shape can be formed. Thus, by alternately arranging apex stones $C_1$ and $C_2$, it is possible to obtain automatically a correct arrangement during setting. From FIG. 2, it can be further seen that, as a result of the amount of offset of the curved element, the smaller outer edge b on the left bearing stone A with respect to the right outer edge a of bearing stone B is such that the amount of the offset corresponds to about the width of the individual stone 1 in bearing stone A.

The size of the bearing stones A and B is in a very defined relationship with respect to the magnitude of the rise-to-span ratio of arch of the curve, whereby the bearing stones fit in pairs under the standard curve, which is very useful during adjustment operations.

FIG. 3 shows a setting pattern of a plurality of paving stone elements in accordance with the invention for performing a curved paving. In the left upper curved element, a left bearing stone A having individual stones 1, 2 and 3, an apex stone $C_1$ having individual stones 7, 8 and 9 and a right bearing stone B having individual stones 4, 5 and 6 is shown, where the individual stones are separated from each other by non-continuous separating joints. In the next row, two curved elements are set, each of which consist of one left bearing stone A and one right bearing stone B, where the apex stones $C_2$ are provided with only two individual stones. The subsequent row is again shaped as the first row, namely with a bearing stone A, an apex stone $C_1$ with three individual stones 7, 8 and 9 and a bearing stone B. This sequence is repeated.

On the individual stone 4 of bearing stones B the adjacent corresponding curved elements with bearing stones A and B and alternating apex stones $C_1$ and $C_2$ are joined to the individual stones 4 of bearing stones B above described. This sequence is continued in the third row, etc. In order to clarify the pattern of setting, the individual abutting curved elements are characterized by a thick drawn line L.

FIG. 4 shows a further pattern of setting of a curved paving, where the individual curved elements mesh in the shape of waves. Thus, the subsequent curved elements are offset with respect to each other by about 180°.

For adjustment purposes, stones may be broken off in a simple manner from bearing stones A and B or apex stones $C_1$, $C_2$, so as to obtain a precise finished shape. Thus, it is advantageous that only a single shape is required, which simplifies stockpiling.

Furthermore, the stones can be equipped with hidden distance cams, designated 10 in FIG. 5, and the center of the curve can be marked.

Thus, it is possible in accordance with the invention to offset or set the paving stone in a normal manner by hand or mechanically, whereby the optical appearance corresponds to one of a curve paving with normal stones.

While only one embodiment of the present invention has been shown and described, it is obvious that many changes and modifications may be made thereunto without departing from the spirit and scope of the invention.

What is claimed is:

1. In a curved like paving stone element for setting of a curved paving, wherein the curved element is defined by an outer circular curve and an inner circular curve having equal radii, the center points of the circular curves being disposed on a radial straight, being the line including these points, the improvement comprising the center points of the circular curves being disposed at a distance which corresponds to the largest width of the curved element, the curved element including two outer stones and a center stone of about the same curvature length, the outer stones having upper surfaces subdivided into three segments and the center stone having an upper surface subdivided into at least two segments, said subdivisions formed by means of grooves, wherein the curved element is asymmetrically offset with respect to the radial straight in such a manner that the outer edge of an outer stone is similar than the opposing outer edge of the other outer stone, the size of the offset corresponding to about the width of the individual stone having the smaller outer edge, whereby a second curved element having an outer stone corresponding to the outer stone of the first curved element can be positioned adjacent to said first curved element so that its outer stone is located in said offset.

2. A paving stone element in accordance with claim 1, wherein said center stone is subdivided into three individual stones.

3. A paving stone element in accordance with claim 1, wherein the inner and outer radii of the outer and inner defining circular curves are equal to four times the distance separating the center points of the circular curves on the radial straight.

4. A paving stone element in accordance with claim 3, wherein the width of the span of the outer circular curve between adjacent paving stone elements is six times the distance separating the center points of the circular curves on the radial straight and the total length of the span of the outer circular curve is 6.4271 times such distance.

5. A paving stone element in accordance with claim 4, wherein the curvature angle of the outer circular curve is 107.5437°, the curvature angle of the inner circular curve is 88.6227°, the curve length of the outer circular curve is 7.5082 times the distance separating the center points of the circular curves on the radial straight and the curve length of the inner circular curve (Ki) is 6.1870 times such distance.

6. A paving stone element in accordance with claim 1, which further includes hidden distance cams provided on said stones.

* * * * *